US005510035A

United States Patent [19]

Törönen et al.

[11] Patent Number: 5,510,035

[45] Date of Patent: Apr. 23, 1996

[54] METHOD OF SEPARATING SODIUM HYDROXIDE FROM WHITE LIQUOR

[75] Inventors: Marjo Törönen, Rauha; Hannu Kurittu, Imatra, both of Finland

[73] Assignee: Enso-Gutzeit Oy, Imatra, Finland

[21] Appl. No.: 325,655

[22] Filed: Oct. 18, 1994

[30] Foreign Application Priority Data

Oct. 20, 1993 [FI] Finland ..... 934632

[51] Int. Cl.[6] ..... B01D 11/00

[52] U.S. Cl. ..... 210/644; 210/649; 162/30.11; 162/42; 162/43

[58] Field of Search ..... 210/644, 649, 210/651; 162/29, 35, 36, 41, 44, 60, 42, 189, 190, 43, 30.11; 423/DIG. 3; 204/182.3

[56] References Cited

U.S. PATENT DOCUMENTS

| | | | |
|---|---|---|---|
| 2,302,270 | 11/1942 | Skolnik | 210/644 |
| 3,988,198 | 10/1976 | Wilson et al. | 162/30 |
| 4,024,229 | 5/1977 | Smith et al. | 162/82 |
| 4,093,508 | 6/1978 | Henricson | 162/30.11 |
| 4,519,881 | 5/1985 | Chang et al. | 204/182.3 |
| 4,602,982 | 7/1986 | Samuelson | 162/40 |

FOREIGN PATENT DOCUMENTS 326270 6/1972 U.S.S.R. .

OTHER PUBLICATIONS

Chemical Abstracts, vol. 104, 1986, Abstract No. 52978.
Chemical Abstracts, vol. 116, 1992, Abstract No. 135712.

*Primary Examiner*—Ana M. Fortuna
*Attorney, Agent, or Firm*—Nikaido, Marmelstein, Murray & Oram

[57] ABSTRACT

The present invention relates to a method of processing white liquor (3) obtained from the causticization step of a pulp mill, in which method infeed white liquor (3) principally contains sodium hydroxide (6) and sodium sulfide (7). The method according to the invention is characterized in that the sodium hydroxide (6) contained in the white liquor (3) is separated from the white liquor (3) either entirely or partly by means of a diffusion dialysis membrane process (4). The invention is further characterized in that the sodium hydroxide (6) separated from the white liquor (3) is advantageously entirely returned back to the chemical circulation of the pulp mill.

6 Claims, 4 Drawing Sheets

METHOD OF SEPARATING SODIUM HYDROXIDE FROM WHITE LIQUOR

The present invention relates to a method for separating sodium hydroxide from white liquor.

In the near future, the production volume of totally chlorine free pulps (TCF pulps) manufactured entirely without the use of chlorine bleaching chemicals will increase. With the change to oxygen-peroxide-based bleaching methods, the need by bleach plants for a supply of purified sodium hydroxide, NaOH, will increase. Besides, the manufacture of TCF pulps will permit effluent-free closed-cycle circulation of bleach plant waters and their recycling back to the chemical circulation. When such water circulations are closed, sodium will accumulate in the chemical recovery cycle in excess amounts, but, unfortunately, in difficult-to-utilize form.

Bleaching of TCF pulps requires purified NaOH to keep the consumption of other bleaching chemicals as low as possible. Conventionally, pulp mills have been forced to purchase such purified caustic soda for the needs of the bleach plant from chemical suppliers. As the closed-cycle operation of the bleach plant of a paper mill and its chemical cycles results in excess accumulation of sodium in the chemical recovery cycle, in-plant production of NaOH directly from the chemical circulation becomes a topical issue.

Purified caustic soda, NaOH, is used in the plant mostly in pulp bleaching, at its alkaline step proper, and additionally in other alkaline steps of the bleach plant including the production of sodium hypochlorite, use as the make-up chemical of the chemical circulation and as a neutralizing agent. Purified caustic soda is also used in scrubbing of stack gases. Sodium sulfite, $Na_2SO_3$ obtained from the scrubber can be returned back to the chemical circulation.

According to the prior art, the principal method of sodium hydroxide production is the electrolysis of sodium chloride into chlorine and so-called equivalent caustic. NaOH can also be produced by other methods, e.g., using the cooling-crystallization-causticization process in which green liquor is first cooled to crystallize the sodium carbonate contained therein and then the sodium carbonate is causticized. Such a process requires the use of two parallel causticization lines from this point on up to the separation of the caustic soda.

Conventional methods of producing NaOH also include electrodialytic decomposition of sodium sulfate into NaOH and sulfuric acid, whereby the caustic concentration thus obtained is approx. 15% NaOH.

The basic unit in the conventional technology of NaOH production is the electrolysis cell. It serves for the decomposition of an extremely pure solution of NaCl by direct current. Two main types of electrolysis cell are in general use: the mercury cell and the membrane cell. The number of cells in a plant is typically from 50 to 100 cells in series. A mercury cell is formed by two parts: a primary cell and a secondary cell. The primary cell has a titanium anode (connected to the positive potential) on which chlorine gas is formed and a moving mercury cathode on which the sodium formed amalgamates with mercury. The amalgam flows into the secondary cell where it is mixed with water, whereby the amalgam is decomposed into sodium hydroxide, hydrogen gas and metallic mercury. The mercury is returned back to the primary cell. The sodium hydroxide is recovered as a 50% aqueous solution. In the membrane cell, the anode and cathode spaces are separated from each other by a selective ion-exchange membrane. The membrane permits migration of sodium ions only. Then, chlorine is formed at the anode, while hydrogen and sodium hydroxide are formed at the cathode. The sodium hydroxide is recovered as a 20% aqueous solution, which must be concentrated by evaporation for storage and transport.

It is an object of the present invention to provide a system in which a required amount of white liquor can be sidestreamed from the chemical circulation to the production of purified NaOH for the needs of, e.g., the bleach plant thus requiring no purchase of caustic soda and providing a method of balancing the chemical recovery cycle. The method according to the invention is characterized by what is stated in the annexed claims.

According to the invention, a diffusion dialysis process can be employed for separating a sufficient amount of purified sodium hydroxide from white liquor without disturbing the sodium-sulfur balance of the chemical recovery cycle. The end product is an 8% solution of caustic soda which can be used as such in the bleaching stage. A second fraction obtained by the process is a sodium sulfide fraction (pH greater than 10), which can be passed to the cooking process, whereby a so-called sulfur-containing cooking process results capable of improving pulp qualities and increasing yield.

Further according to the invention, the diffusion dialysis process can be employed by sidestreaming a required portion of white liquor from the pulp mill's own chemical recovery cycle and then passing the white liquor sidestream to the diffusion dialysis equipment, whereby purified caustic of approx. 8% concentration is obtained, together with a sodium sulfide fraction which can be passed to the digester. The principal benefits of the diffusion dialysis process with regard to the above-described conventional methods of caustic production include a low specific energy consumption. In the diffusion dialysis process, energy is consumed only for pumping the feed solutions. By contrast, the electric energy consumption of electrodialysis is approx. 3000 kWh per ton of 100% NaOH, which is slightly less than the specific energy consumption of the conventional electrolysis method of caustic production. On the other hand, the cooling-crystallization-causticization process requires a separate causticization line, which causes a high investment cost of equipment.

The diffusion dialysis equipment is easy to connect to the plant's chemical recovery cycle owing to its moderate headroom. The processing capacity of the equipment is easy to expand or cut back according to the production needs. The process can be operated without special monitoring as its operation in principle is self-contained. Moreover, excess amounts of sodium will be readily available in the future as the trend is toward closed-cycle operation of the chemical circulations. Then, the diffusion dialysis process according to the invention is the only practicable method to recover sodium from the chemical circulation back to the cooking process thus offering a superior approach over conventional techniques.

The cation-exchange membrane has a polymer matrix structure to which cationic groups are bonded. The polymer matrix typically is made from a polystyrene, polyethylene, polysulfone, polytetrafluoroethylene or fluorinated ethylene polymer resin. The support structure of the membrane can be manufactured from polystyrene, for instance. The cationic group can be a sulfite or carboxylic acid group. As mentioned above, the cation-exchange membrane selectively permits migration of cationic species, in the present case, sodium ions. As to the anionic species, no other anions except the hydroxyl ion can pass the membrane. By altering such membrane properties as its porosity, ion-exchange capacity and relative proportion of the support structure, the ion permeability properties of the membrane can be varied thus permitting optimization of desired caustic and salt concentrations in the end product obtained from the process. The white liquor, which is used as the infeed to the process, contains sodium hydroxide and sodium sulfide when received from causticization through a clarifier. The sodium ion of the liquor can diffuse through the cation-exchange membrane, while the sulfide ion and other anions cannot.

The invention is next examined in greater detail on the basis of comparative tests performed in laboratory scale with reference to the appended drawings, in which:

DETAILED DESCRIPTION

Figure 1:
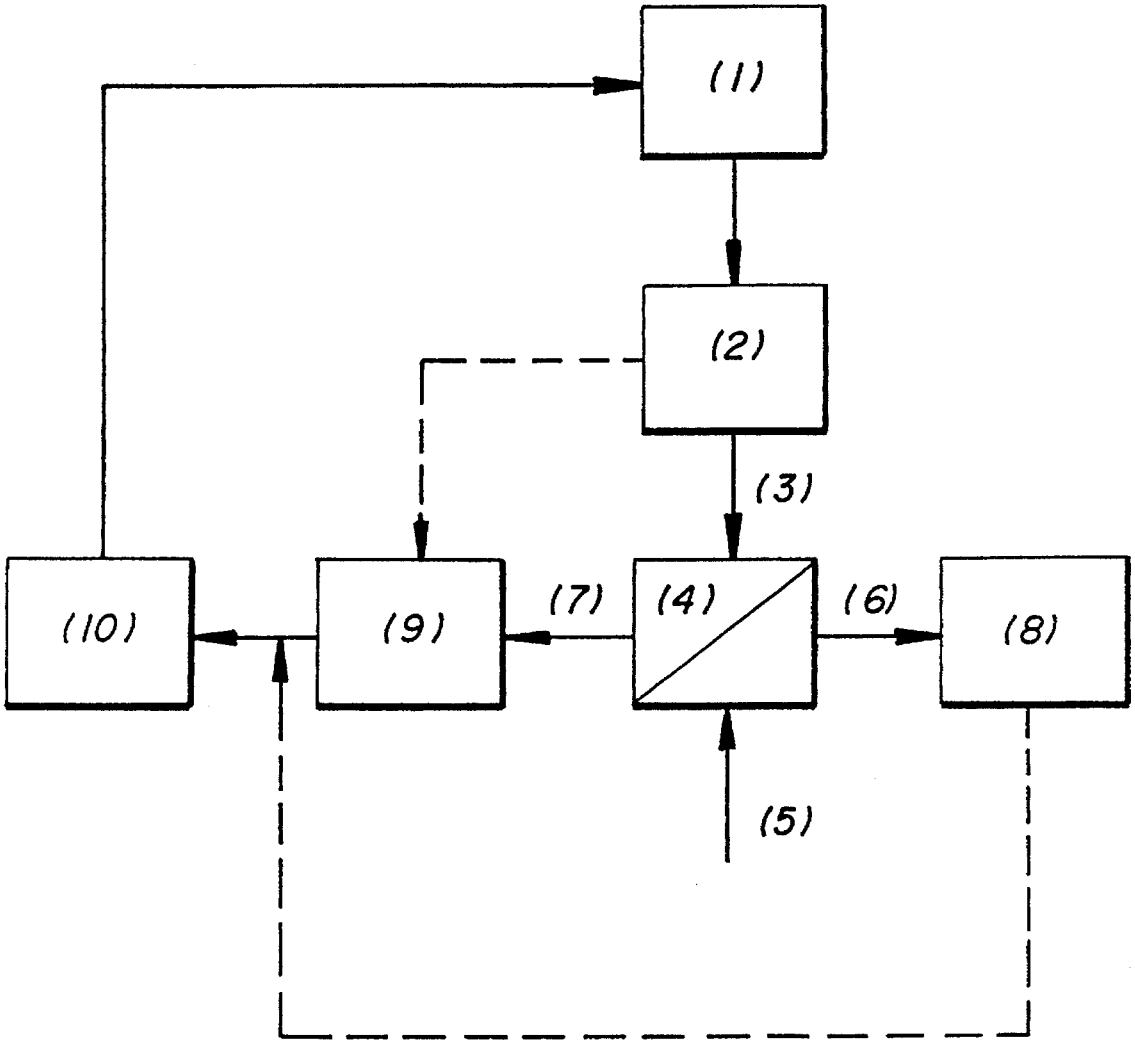
FIG. 1 is a flowsheet of an embodiment of the process according to the invention.
Figure 2:
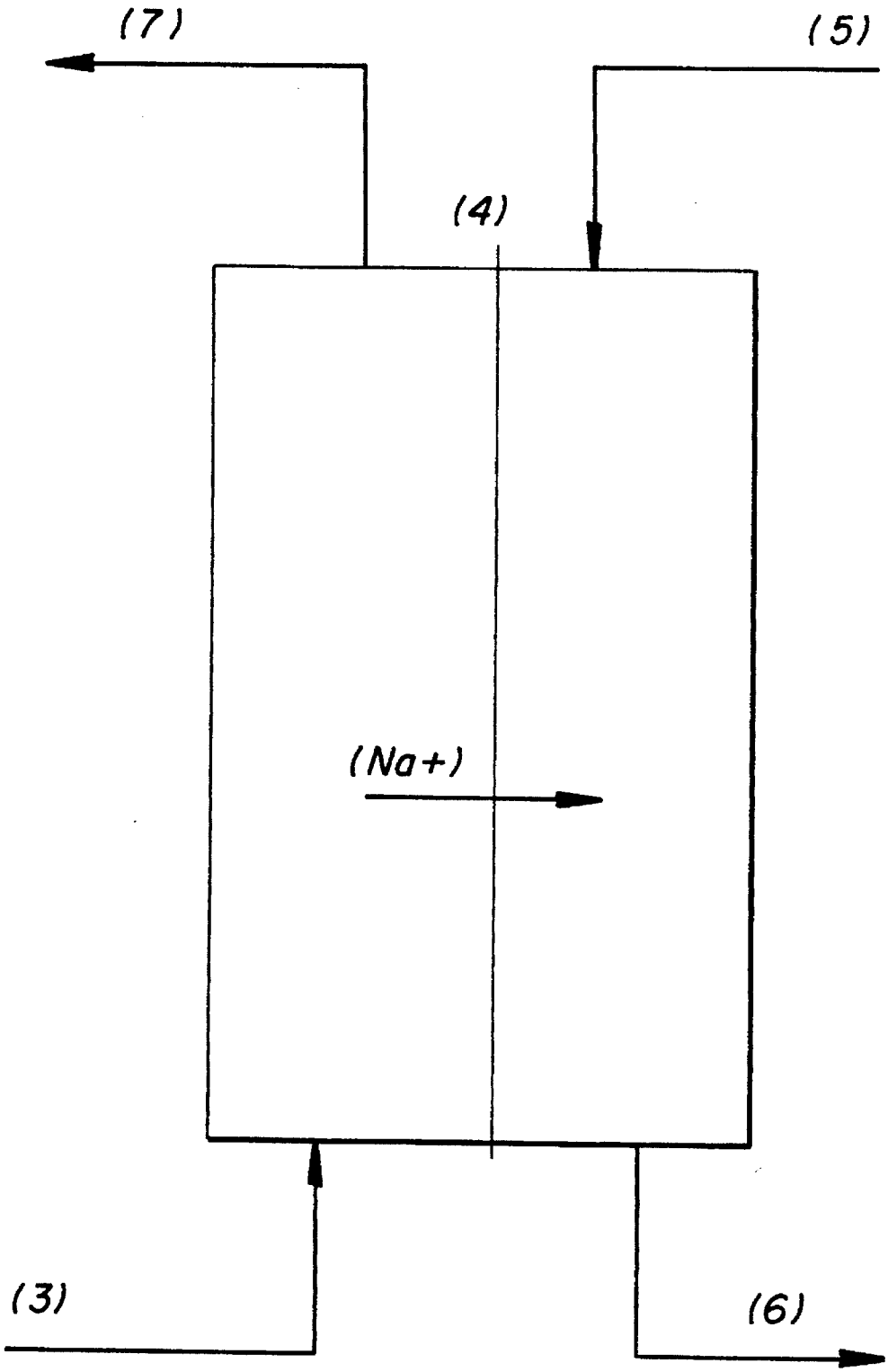
FIG. 2 is a schematic diagram of diffusion dialysis equipment suited for implementing the method illustrated in FIG. 1.

With reference to FIGS. 1 and 2, an embodiment of the method as well as compatible equipment are illustrated comprising a membrane pack of cation-exchange membranes (4), feed pumps of water (5) and white liquor (3), and infeed and end product tanks. The membrane pack comprises a required number of cation-exchange membranes (4) which are selectively permeable to cations. On the other hand, the membrane (4) is very selective also to $H^+$ ions, and consequently, the diffusion of these ions through the membrane is most intense. On the other hand, the diffusion of salts through the membrane is extremely slow, and the cation-exchange membrane (4) thus acts as a passive barrier. In terms of efficient operation of the equipment, the goal is to separate the maximum amount of caustic from the white liquor. However, as the size of the equipment will then become unavoidably large, balanced selection of desired caustic concentration versus equipment size must be performed in an optimal fashion according to the needs of each plant. In any case, the goal of the process is to separate at least 60% of the caustic contained in the infeed liquor simultaneously keeping the sodium sulfide concentration in the outlet product stream to a minimum.

Typical composition of white liquor is as follows:

| | |
|---|---|
| NaOH | 80 . . . 100 g/l |
| $Na_2S$ | 50 . . . 65 g/l |
| $Na_2CO_3$ | 20 . . . 30 g/l |
| $Na_2SO_4$ | 5 . . . 6 g/l |
| $Na_2S_2O_3$ | 0.1 g/l |
| other | 0.2 g/l |

According to the invention, a sidestream of required amount of white liquor is taken after the causticization step (2) and fed into the diffusion dialysis cell. Water is pumped to the cell countercurrently. The obtained purified caustic fraction (6) is advantageously returned back to the bleaching stage (8). Correspondingly, the sulfide fraction (7) is most preferably returned back to the digester (9) and therefrom further to the soda furnace (1). In this fashion, both fractions are returned after the evaporation step (10) back to the chemical circulation. The process is advantageously operated countercurrently, whereby water (5) is passed into the membrane pack from above, and white liquor (3) (in accordance with the comparative tests performed in laboratory scale) having the concentrations of $v_1$=100 g/l NaOH and $s_1$=60 g/l $Na_2S$ is passed into the pack from below. The sodium ions ($Na^+$) of the white liquor (3) are transported by diffusion through the cation-exchange membrane (4) to the water stream (5), whereby the caustic fraction (6) is passed out from the dialysis process from below again in accordance with the comparative tests performed in laboratory scale having the concentrations of $v_2$=75 g/l NaOH and $s_2$=15 g/l $Na_2S$. Simultaneously, the sodium sulfide (7) of the white liquor (3) remains in the feed stream and is passed out from the process via the top of the membrane pack, whereby the chemical concentrations of the outlet stream are $v_3$= 25 g/l NaOH and $s_3$=45 g/l $Na_2S$, respectively. The input pumping volume rate of water (5) to white liquor (3) is most preferably 1.5:1 when the white liquor infeed volume rate is 1.6 l/h/$m^2$ and the process temperature approx. 20° C.

Figure 3:
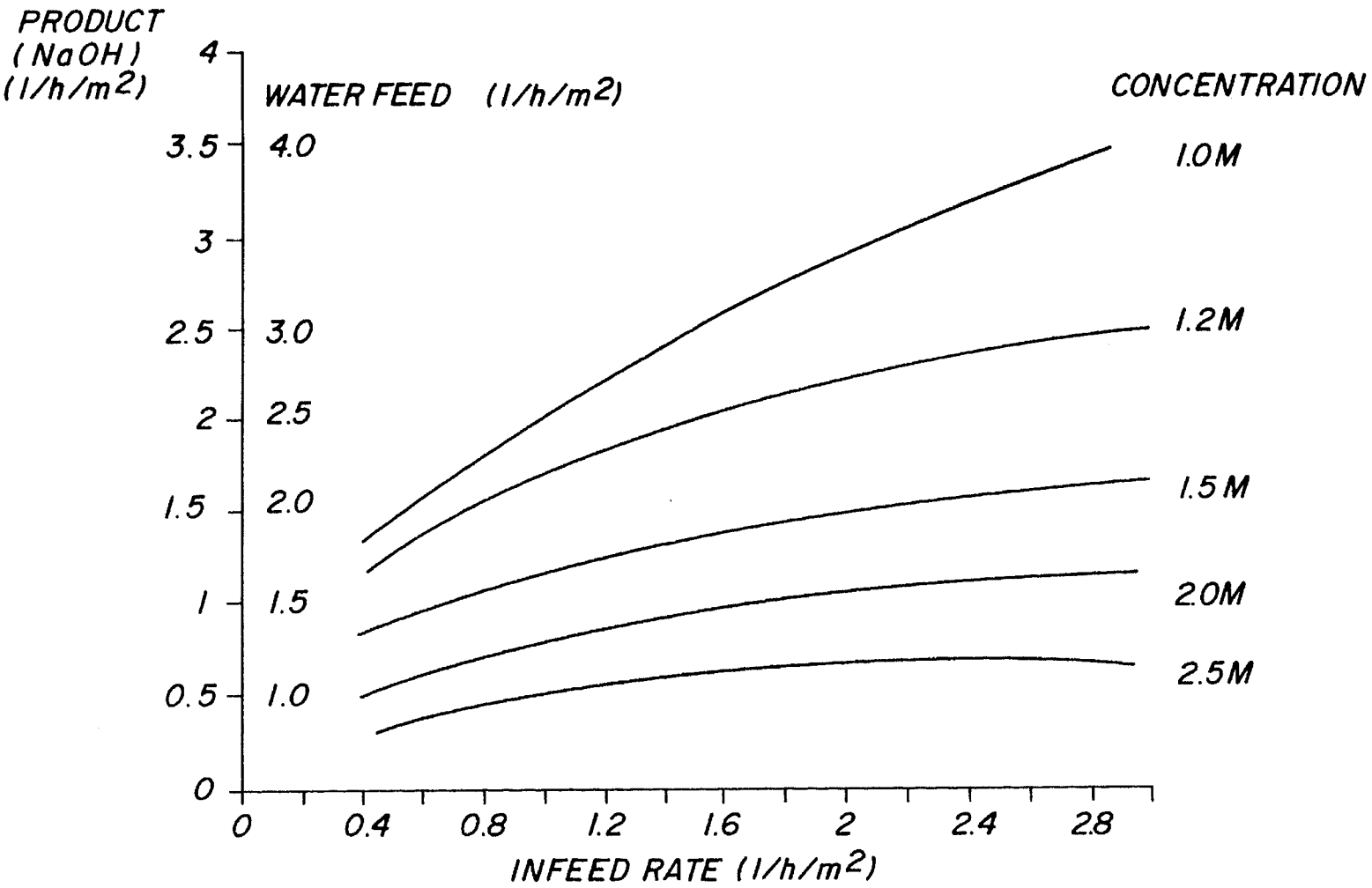
FIG. 3 shows the relationship between the infeed rate, water feed rate and product rate in the dialysis process of the invention.
Figure 4:
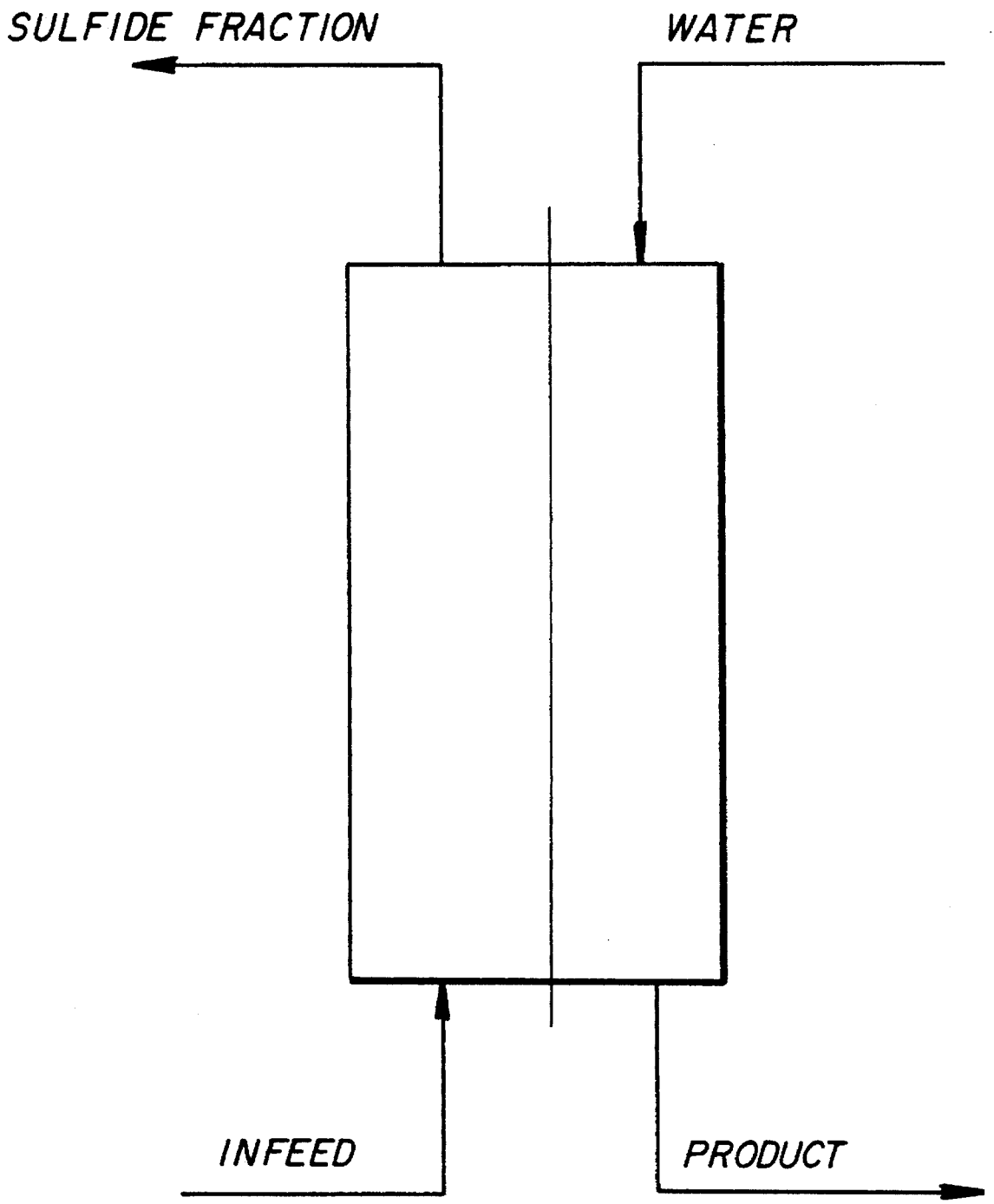
FIG. 4 is a mass balance sheet of white liquor processing in accordance with the present invention.

The results of the laboratory tests with different white liquor infeed volume rates are given in Tables 1–3. Graphs computed on the basis of the tabulated test data are shown in FIG. 3, where the obtained end product concentrations and volumes are plotted as a function of the infeed volume rate. The results indicate that the process operates reliably in the fashion required by the invention. Given in FIG. 4 (and below) is the mass balance sheet, computed on the basis of the results from laboratory tests performed using the method according to the invention, for a paper mill producing 500,000 t of pulp per annum at a chemical consumption level of 30 kg NaOH/t pulp. The following is the mass balance of the streams shown in FIG. 4:

White Liquor
30 kg NaOH/ton pulp
500,000 t pulp/a
15,000 t NaOH/a
1712 kg NaOH/h
21 $m^3$ NaOH/h
360 l NaOH/min
Sulfide Fraction
1.9l/h/$m^2$
0.3 mol/l NaOH
0.5 mol/l $Na_2S$
S=77%
A=52 g/l
Water
1.5 l/h/$m^2$
Infeed
1.4 l/h/$m^2$
2.14 mol/l NaOH
0.7 mol/l $Na_2S$
S=40%
AA=142 g/l
Product
375 l NaOH/t pulp
1 l/h/$m^2$
2 mol/l NaOH
0.1 mol/l $Na_2S$
S=9%
AA=90 g/l.

Run-time control of the quantity and concentration of the two fractions, the purified NaOH fraction and the sulfide fraction which are obtained by the diffusion dialysis process according to the invention is possible by way of adjusting the relationship of the chemical infeed and water volume pumping rates, as shown in FIG. 3.

The method according to the invention also facilitates the use of so-called oxidized white liquor as the chemical infeed. When oxidized white liquor is used, the two fractions obtained are: purified caustic and sodium thiosulfate. The invention further concerns the use of diffusion dialysis to the end of separating sodium hydroxide from white liquor.

To those versed in the art it is obvious that the different applications of the invention ere not limited to the preferred embodiments described above, but rather, can be varied within the scope of the invention which is defined in the appended claims.

TABLE 1

| Flow rates [l/h] | | | | | | | PRODUCT (NaOH) | | WASTE (sulfide) | | | |
|---|---|---|---|---|---|---|---|---|---|---|---|---|
| (WL, white liquor) | | NaOH | Waste | Water | | Ratio | NaOH | Sulfide | NaOH | Sulfide | YIELD | |
| [l/h] | [l/h/m$^2$] | [l/h] | [l/h] | [l/h] | [l/h/m$^2$] | Water/WL | [g/l] | [g/h] | [g/l] | [g/l] | NaOH % | Sulfide % |
| 0.2 | 0.5 | 0.4 | 0.4 | 0.6 | 1.5 | 3 | 45.6 | 10.76 | 0 | 20.59 | 106.74 | 36.40 |
| 0.22 | 0.55 | 0.23 | 0.38 | 0.39 | 0.975 | 1.77 | 81.04 | 21.22 | 4.96 | 23.71 | 99.16 | 37.52 |
| 0.64 | 1.6 | 0.24 | 0.77 | 0.37 | 0.925 | 0.58 | 104.7 | 26.83 | 37.68 | 40.56 | 45.95 | 17.02 |
| 0.33 | 0.825 | 0.24 | 0.48 | 0.39 | 0.975 | 1.18 | 93.5 | 23.58 | 15.04 | 29.33 | 79.59 | 28.98 |
| 0.412 | 1.03 | 0.24 | 0.55 | 0.38 | 0.95 | 0.92 | 97.13 | 25.9 | 20.8 | 33.38 | 66.22 | 25.52 |
| 0.43 | 1.075 | 0.375 | 0.598 | 0.643 | 1.3575 | 1.26 | 74.8 | 17 | 13.38 | 32.78 | 76.35 | 25.08 |
| 0.41 | 1.025 | 0.48 | 0.595 | 0.665 | 1.6625 | 1.62 | 59.84 | 12.64 | 10.08 | 31.2 | 82.00 | 25.03 |
| 0.159 | 0.3975 | 0.365 | 0.439 | 0.645 | 1.6125 | 4.06 | 55.36 | 11.08 | 2.74 | 22.93 | 148.74 | 43.02 |
| 0.561 | 1.4025 | 0.562 | 0.755 | 0.756 | 1.89 | 1.35 | 61.44 | 11.7 | 16.96 | 34.94 | 72.17 | 19.86 |
| 0.538 | 1.345 | 0.676 | 0.758 | 0.896 | 2.24 | 1.67 | 53.6 | 9.83 | 13.52 | 32.45 | 78.83 | 20.89 |
| 0.574 | 1.435 | 0.804 | 0.819 | 1.05 | 2.626 | 1.83 | 47.6 | 9.2 | 12.88 | 32.14 | 78.04 | 21.80 |
| 0.733 | 1.8325 | 0.699 | 0.941 | 0.907 | 2.2676 | 1.24 | 57.84 | 10.14 | 23.68 | 37.91 | 64.56 | 16.56 |
| 0.721 | 1.8025 | 0.927 | 0.967 | 1.173 | 2.9325 | 1.63 | 46.84 | 8.42 | 20.16 | 35.72 | 70.18 | 18.31 |
| 0.737 | 1.8425 | 1.054 | 1.007 | 1.327 | 3.3175 | 1.80 | 42.96 | 7.64 | 19.36 | 32.45 | 71.91 | 18.48 |
| 0.898 | 2.245 | 0.606 | 1.097 | 0.805 | 2.0125 | 0.90 | 68 | 11.7 | 34.16 | 41.03 | 53.71 | 13.36 |
| 0.907 | 2.2675 | 0.754 | 1.108 | 0.955 | 2.3875 | 1.05 | 56.24 | 8.89 | 31.84 | 40.87 | 54.72 | 12.50 |
| 0.91 | 2.275 | 0.896 | 1.132 | 1.311 | 3.2776 | 1.44 | 50.88 | 7.96 | 29.36 | 39.16 | 58.63 | 13.26 |
| 0.918 | 2.295 | 0.454 | 1.082 | 0.618 | 1.545 | 0.67 | 80.08 | 14.66 | 39.36 | 42.9 | 46.35 | 12.26 |
| 1.122 | 2.805 | 0.794 | 1.322 | 0.995 | 2.4875 | 0.89 | 57.92 | 9.05 | 39.84 | 43.37 | 47.97 | 10.83 |
| 1.145 | 2.8626 | 1.014 | 1.372 | 1.241 | 3.1025 | 1.08 | 49.12 | 7.02 | 35.76 | 42.59 | 50.91 | 10.52 |
| 1.113 | 2.7825 | 1.409 | 1.402 | 1.698 | 4.245 | 1.59 | 39.76 | 6.08 | 29.68 | 39.78 | 58.91 | 13.02 |
| 0.437 | 1.0925 | 0.254 | 0.562 | 0.379 | 0.9475 | 0.87 | 90.32 | 19.19 | 26.64 | 35.41 | 61.44 | 18.87 |
| 0.612 | 1.53 | 0.32 | 0.742 | 0.46 | 1.15 | 0.75 | 86.08 | 17.32 | 33.52 | 37.6 | 52.68 | 15.32 |

TABLE 2

| Infeed flow rate [l/h] | | | Product stream flow rate | | | Waste stream flow rate | | | Sulfidity | | Active alkali | |
|---|---|---|---|---|---|---|---|---|---|---|---|---|
| WL [l/h/m$^2$] | NaOH [mol/l] | $Na_2S$ [l/h/m$^2$] | Product [mol/l] | NaOH [mol/l] | $Na_2S$ [l/h/m$^2$] | Waste [l/h/m$^2$] | NaOH [mol/l] | $Na_2S$ [mol/l] | NaOH [%] | $Na_2S$ [%] | NaOH [g/l] | $Na_2S$ [g/l] |
| 0.50 | 2.14 | 0.71 | 1.00 | 1.14 | 0.14 | 1.00 | 0.00 | 0.26 | 19.46 | 100.00 | 56.63 | 21.10 |
| 0.55 | 2.15 | 0.72 | 0.58 | 2.03 | 0.27 | 0.95 | 0.12 | 0.30 | 21.16 | 83.05 | 102.79 | 29.26 |
| 1.80 | 2.15 | 0.71 | 0.60 | 2.62 | 0.34 | 1.93 | 0.94 | 0.62 | 20.80 | 52.46 | 132.20 | 79.25 |
| 0.83 | 2.14 | 0.71 | 0.60 | 2.34 | 0.30 | 1.20 | 0.38 | 0.38 | 20.53 | 66.65 | 117.65 | 45.10 |
| 1.03 | 2.14 | 0.71 | 0.60 | 2.43 | 0.33 | 1.38 | 0.62 | 0.43 | 21.47 | 62.19 | 123.67 | 55.01 |
| 1.08 | 2.14 | 0.71 | 0.94 | 1.87 | 0.22 | 1.50 | 0.33 | 0.42 | 18.89 | 71.64 | 92.23 | 46.94 |
| 1.03 | 2.14 | 0.71 | 1.20 | 1.50 | 0.16 | 1.49 | 0.25 | 0.40 | 17.80 | 76.03 | 72.80 | 42.06 |
| 0.40 | 2.14 | 0.71 | 0.91 | 1.38 | 0.14 | 1.10 | 0.07 | 0.29 | 17.02 | 89.56 | 68.72 | 26.24 |
| 1.40 | 2.14 | 0.71 | 1.41 | 1.54 | 0.16 | 1.89 | 0.42 | 0.45 | 16.33 | 67.86 | 73.43 | 52.77 |
| 1.35 | 2.14 | 0.71 | 1.69 | 1.34 | 0.13 | 1.90 | 0.34 | 0.42 | 15.82 | 71.10 | 63.68 | 46.78 |
| 1.44 | 2.14 | 0.71 | 2.01 | 1.19 | 0.12 | 2.05 | 0.32 | 0.41 | 16.54 | 71.89 | 57.03 | 45.82 |
| 1.83 | 2.14 | 0.71 | 1.75 | 1.45 | 0.13 | 2.35 | 0.69 | 0.49 | 15.23 | 62.13 | 68.23 | 62.54 |
| 1.80 | 2.14 | 0.71 | 2.32 | 1.17 | 0.11 | 2.42 | 0.50 | 0.48 | 15.62 | 64.49 | 55.27 | 56.77 |
| 1.84 | 2.14 | 0.71 | 2.64 | 1.07 | 0.10 | 2.52 | 0.48 | 0.42 | 15.42 | 63.21 | 50.79 | 52.62 |
| 2.25 | 2.14 | 0.71 | 1.52 | 1.70 | 0.15 | 2.74 | 0.85 | 0.53 | 14.99 | 55.18 | 79.99 | 76.22 |
| 2.27 | 2.14 | 0.71 | 1.89 | 1.41 | 0.11 | 2.77 | 0.80 | 0.62 | 13.94 | 56.82 | 65.35 | 73.73 |
| 2.28 | 2.14 | 0.71 | 2.24 | 1.27 | 0.10 | 2.83 | 0.73 | 0.50 | 13.82 | 57.76 | 59.04 | 69.50 |
| 2.30 | 2.14 | 0.71 | 1.14 | 2.00 | 0.19 | 2.71 | 0.98 | 0.55 | 15.80 | 52.77 | 95.11 | 83.33 |
| 2.81 | 2.14 | 0.71 | 1.99 | 1.45 | 0.12 | 3.31 | 1.00 | 0.56 | 13.80 | 52.74 | 67.20 | 84.29 |
| 2.86 | 2.14 | 0.71 | 2.53 | 1.23 | 0.09 | 3.43 | 0.89 | 0.55 | 12.78 | 54.97 | 56.32 | 79.41 |
| 2.78 | 2.14 | 0.71 | 3.62 | 0.99 | 0.08 | 3.51 | 0.74 | 0.61 | 13.66 | 57.87 | 45.99 | 70.45 |
| 1.09 | 2.14 | 0.71 | 0.64 | 2.26 | 0.25 | 1.41 | 0.67 | 0.45 | 17.88 | 57.67 | 109.99 | 62.94 |
| 1.53 | 2.14 | 0.71 | 0.80 | 2.15 | 0.22 | 1.86 | 0.84 | 0.48 | 17.10 | 53.48 | 103.83 | 72.06 |

TABLE 3

| dC(NaOH) [mol/l] | dC($Na_2S$) [mol/l] | Flux NaOH [mol/h/$m^2$] | $Na_2S$ [mol/h/$m^2$] | $H_2O$ [mol/h/$m^2$] | $Na^+$ | U/dc NaOH | U/dC $Na_2S$ | U(NaOH)/ U/($Na_2S$) | ESR | YIELD NaOH [%] | $Na_2S$ [%] |
|---|---|---|---|---|---|---|---|---|---|---|---|
| ERR | 0.40 | 1.14 | 0.14 | 0.08 | 1.42 | ERR | 0.35 | ERR | 2.73 | 160.74 | 36.40 |
| 0.12 | 0.37 | 1.16 | 1.16 | 0.05 | 1.48 | 9.7 | 0.43 | 23.29 | 2.46 | 99.16 | 37.52 |
| ERR | 0.44 | 1.57 | 0.21 | 0.05 | 1.98 | ERR | 0.47 | ERR | 2.52 | 45.95 | 17.02 |
| ERR | 0.39 | 1.40 | 0.18 | 0.05 | 1.76 | ERR | 0.46 | ERR | 2.56 | 79.59 | 28.98 |
| ERR | 0.40 | 1.46 | 0.20 | 0.05 | 1.86 | ERR | 0.60 | ERR | 2.42 | 66.22 | 25.52 |
| 0.30 | 0.45 | 1.75 | 0.20 | 0.08 | 2.16 | 5.87 | 0.45 | 13.03 | 2.84 | 76.35 | 25.08 |
| 0.42 | 0.47 | 1.80 | 0.19 | 0.09 | 2.18 | 4.31 | 0.41 | 10.39 | 3.05 | 82.00 | 25.03 |
| 9.29 | 0.41 | 1.26 | 0.13 | 0.09 | 1.52 | 4.43 | 0.31 | 14.16 | 3.22 | 148.74 | 43.02 |
| 0.61 | 0.50 | 2.16 | 0.21 | 0.10 | 2.58 | 4.26 | 0.42 | 10.11 | 3.39 | 72.17 | 19.86 |
| 0.53 | 0.49 | 2.26 | 0.21 | 0.12 | 2.89 | 4.24 | 0.43 | 9.82 | 3.52 | 78.83 | 20.89 |
| 0.58 | 0.50 | 2.39 | 0.24 | 0.15 | 2.87 | 4.13 | 0.48 | 8.63 | 3.34 | 78.04 | 21.80 |
| 0.64 | 0.53 | 2.53 | 0.23 | 0.13 | 2.98 | 3.95 | 0.43 | 9.22 | 3.68 | 64.58 | 16.36 |
| 0.71 | 0.53 | 2.70 | 0.25 | 0.16 | 3.20 | 3.80 | 0.48 | 7.87 | 3.57 | 70.18 | 18.31 |
| 0.74 | 0.51 | 2.83 | 0.26 | 0.18 | 3.35 | 3.85 | 0.51 | 7.55 | 3.83 | 71.91 | 18.48 |
| 0.62 | 0.54 | 2.58 | 0.23 | 0.11 | 3.03 | 4.14 | 0.42 | 9.86 | 3.75 | 53.71 | 13.36 |
| 0.76 | 0.66 | 2.65 | 0.21 | 0.13 | 3.08 | 3.48 | 0.39 | 9.02 | 4.08 | 54.72 | 12.50 |
| 0.80 | 0.65 | 2.86 | 0.23 | 0.18 | 3.31 | 3.57 | 0.41 | 8.63 | 4.12 | 58.63 | 13.26 |
| 0.43 | 0.53 | 2.27 | 0.21 | 0.09 | 2.70 | 5.33 | 0.40 | 13.35 | 3.62 | 46.35 | 12.26 |
| 0.83 | 0.57 | 2.87 | 0.23 | 0.14 | 3.33 | 3.45 | 0.40 | 8.59 | 4.13 | 47.97 | 10.83 |
| 0.90 | 0.58 | 3.11 | 0.23 | 0.17 | 3.67 | 3.46 | 0.39 | 8.79 | 4.51 | 50.91 | 10.52 |
| 0.93 | 0.57 | 3.60 | 0.27 | 0.24 | 4.05 | 3.77 | 0.48 | 7.80 | 4.22 | 58.91 | 13.02 |
| ERR | 0.46 | 1.43 | 0.16 | 0.05 | 1.75 | ERR | 0.34 | ERR | 3.04 | 61.44 | 18.87 |
| ERR | 0.48 | 1.72 | 0.18 | 0.08 | 2.08 | ERR | 0.37 | ERR | 3.21 | 52.68 | 15.32 |

We claim:

1. A method of processing white liquor comprising removing white liquor obtained from the causticization step of a pulp mill, the white liquor comprising sodium hydroxide and sodium sulfide, separating sodium hydroxide from said white liquor either entirely or partly by means of membrane diffusion dialysis.

2. A method as defined in claim 1, wherein said sodium hydroxide separated from said white liquor is returned to said pulp mill.

3. A method as defined in claim 1, wherein said sodium hydroxide separated from said white liquor is at least partly returned to a bleaching stage, stack gas scrubbing and/or production of sodium hypochlorite in said pulp mill.

4. A method as defined in claim 1, wherein said sodium sulfide separated from the white liquor is at least partly returned to a cooking step in said pulp mill.

5. A method as defined in claim 1, wherein the amount of sodium hydroxide separated by means of said diffusion dialysis process from said white liquor is at least 50% of the total content of said sodium hydroxide contained in said white liquor.

6. A method as defined in claim 1, wherein the concentration of sodium hydroxide separated by means of said diffusion dialysis from said white liquor is approximately 0.5–3.0 mol/l.

* * * * *